US008659490B2

(12) United States Patent
Walton

(10) Patent No.: US 8,659,490 B2
(45) Date of Patent: Feb. 25, 2014

(54) APPARATUS AND METHOD FOR CLEARING WATER FROM DISH ANTENNA COVERS

(76) Inventor: William D. Walton, Wrightwood, CA (US)

( * ) Notice: Subject to any disclaimer, the term of this patent is extended or adjusted under 35 U.S.C. 154(b) by 460 days.

(21) Appl. No.: 12/687,733

(22) Filed: Jan. 14, 2010

(65) Prior Publication Data

US 2010/0265155 A1 Oct. 21, 2010

Related U.S. Application Data

(60) Provisional application No. 61/145,063, filed on Jan. 15, 2009.

(51) Int. Cl.
*H01Q 1/02* (2006.01)
*H01Q 1/42* (2006.01)

(52) U.S. Cl.
USPC ..... 343/704; 343/840; 343/872

(58) Field of Classification Search
USPC ..... 343/704, 840, 872
See application file for complete search history.

(56) References Cited

U.S. PATENT DOCUMENTS

| | | | | |
|---|---|---|---|---|
| 4,126,864 | A | | 11/1978 | Hopkins |
| 4,213,029 | A | | 7/1980 | Endicott, Jr. et al. |
| 4,259,671 | A | | 3/1981 | Levin |
| 4,368,471 | A | | 1/1983 | Walton, Jr. |
| D268,343 | S | | 3/1983 | Mann et al. |
| 4,479,131 | A | | 10/1984 | Rogers et al. |
| 4,536,765 | A | | 8/1985 | Kaminski |
| 4,581,615 | A | | 4/1986 | Levy |
| 4,804,972 | A | | 2/1989 | Schudel |
| 4,866,452 | A | | 9/1989 | Barma et al. |
| D304,454 | S | | 11/1989 | Serres |
| D305,334 | S | | 1/1990 | Marr |
| 4,918,459 | A | | 4/1990 | De Teso |
| 4,955,129 | A | | 9/1990 | McCauley et al. |
| 4,972,197 | A | | 11/1990 | McCauley et al. |
| 5,010,350 | A | | 4/1991 | Lipkin et al. |
| 5,346,371 | A | * | 9/1994 | Bialy et al. ..... 417/312 |
| 5,353,037 | A | | 10/1994 | Jones |
| 5,368,924 | A | | 11/1994 | Merril, Jr. et al. |

(Continued)

FOREIGN PATENT DOCUMENTS

| | | |
|---|---|---|
| DE | 3201104 | 8/1983 |
| EP | 0326744 | 8/1989 |

(Continued)

OTHER PUBLICATIONS

Unknown author, "Satnews Daily: Is your VSat quakin' in its shoes?" W.B. Walton to the icy rescue . . . , Internet; URL:http://www.satnews.com/cgi-bin/story.cgi?number=1930051155, Mar. 26, 2009.

(Continued)

*Primary Examiner* — Michael C Wimer
(74) *Attorney, Agent, or Firm* — Knobbe, Martens, Olson & Bear, LLP

(57) ABSTRACT

A dish antenna with a cover that inhibits the accumulation of water, liquid or frozen, on the front surface of an antenna. One or more vibration mechanisms are engaged with the cover so as to vibrate the cover when water, either frozen or liquid, may be present on the outer surface of the cover so as to inhibit the water from disrupting signals being transmitted to or from the dish antenna.

20 Claims, 5 Drawing Sheets

(56) References Cited

U.S. PATENT DOCUMENTS

| | | | | |
|---|---|---|---|---|
| 5,451,972 | A | 9/1995 | Franklin | |
| 5,729,238 | A | 3/1998 | Walton | |
| 5,798,735 | A | 8/1998 | Walton | |
| 6,064,344 | A | 5/2000 | Walton | |
| 7,145,499 | B2 * | 12/2006 | Ware et al. | 342/26 R |

FOREIGN PATENT DOCUMENTS

| | | | |
|---|---|---|---|
| JP | 48-31009 | | 9/1973 |
| JP | 57-65033 | | 4/1982 |
| JP | 58-151702 | | 9/1983 |
| JP | 59-207701 | | 11/1984 |
| JP | 01 238202 | A | 9/1989 |
| JP | 2-34004 | | 2/1990 |
| JP | 2-109402 | | 4/1990 |
| JP | 2-109404 | | 4/1990 |
| JP | 05 175715 | A | 7/1993 |
| JP | 09 331203 | A | 12/1997 |
| SU | 1571712 | | 6/1990 |

OTHER PUBLICATIONS

International Search Report dated Mar. 19, 2010 for corresponding PCT Application No. PCT/US2010/021259.

* cited by examiner

APPARATUS AND METHOD FOR CLEARING WATER FROM DISH ANTENNA COVERS

CROSS-REFERENCE TO RELATED APPLICATIONS

This application claims the benefit of U.S. Provisional Application No. 61/145,063 entitled VIBRATING SATELLITE ANTENNA COVER, filed Jan. 15, 2009 which is hereby incorporated by reference in its entirety.

BACKGROUND OF THE INVENTION

1. Field of the Invention

The present invention relates to dish antennas, such as satellite antennas and, in particular, concerns a device and method for reducing the build up of water, frozen or liquid, adjacent the receiving surface of the dish to thereby reduce disruption of the transmission of signals to or from the dish antenna.

2. Description of the Related Art

Dish antennas are antennas that are commonly used for a wide variety of different purposes. For example, large satellite communications antennas both transmit and receive communications from satellites in outer space. Further, the growth of satellite entertainment networks has led to a proliferation of smaller dish shaped receiving antennas that receive signals containing the entertainment from orbiting satellites. Dish-shaped antennas are also used in a wide variety of other communications applications such as microwave transmissions and the like.

While dish shaped antennas are well suited for receiving and transmitting a wide variety of signals, the shape of the antenna leads them to be particularly susceptible to the effects of the build up of water on the antennas. More specifically, dish antennas generally have a concave inner surface where moisture, such as rain, dew, condensation, ice and snow, can accumulate. When sufficient quantities of moisture or water, in either liquid or frozen form, accumulate, the water can disrupt or even completely interrupt the communications of signals to and from the antenna.

To address this problem, various covers have been proposed. For example, U.S. Pat. No. 5,798,735 to Walton provides an example of a particular kind of assembly that is designed to inhibit the accumulation of snow on a dish antenna. In this implementation, the cover extends about the opening that defines the concave inner surface of the dish antenna. The cover is formed of a material, such as polytetrafluoroethylene (PTFE), that allows for the transmission of satellite and other communications signals. The space between the concave inner surface of the dish antenna and the cover can be heated by the introduction of heated air into the space. The heated air then warms the cover and inhibits the accumulation of snow on the outer surface of the cover.

While the system disclosed in U.S. Pat. No. 5,798,735 works well in inhibiting the accumulation of snow and other frozen precipitation on the outer surface of the cover, there are some applications where the introduction of heated air into the air space will be less effective in eliminating or reducing the accumulation of water on the cover. For example, rain, dew or condensation can still accumulate on the outer surface of the cover. Providing heated air into the interior space may not be that effective in reducing this accumulation of this type of moisture. Further, this accumulation of water can also result in the degradation or loss of communications signals with the dish antenna. Also, in some applications, providing heated air into the interior space to reduce the accumulations of frozen precipitation may be costly in terms of energy use.

Hence, there is a need for a system and method of reducing the accumulations of water or moisture, in either frozen or liquid form, on the outer surface of covers of dish antennas. To this end, there is a need for an inexpensive apparatus and method of reducing the accumulation of water on the outer surfaces of covers.

SUMMARY OF THE INVENTION

The aforementioned needs are satisfied, in one embodiment, by a system for protecting communications with dish antennas that, in one implementation, comprises a cover that is positioned on the outer surface of a dish antenna so as to cover the concave opening of the dish antenna. The cover thereby inhibits the accumulation of water, either frozen or liquid, on the inner concave surface of the antenna. The system further includes a mechanical vibration structure that is engaged with the cover that can be selectively activated to induce the cover to vibrate. By vibrating the cover, the accumulation of both frozen and liquid water or moisture on the outer surface of the cover can be reduced.

In one implementation, there is also one or more sensors that sense atmospheric conditions that would lead to the possible or actual accumulations of water on the cover. The one or more sensors can then selectively activate the vibration device so as to reduce the accumulation of water on the cover.

In another implementation, the aforementioned needs are met by a vibratory system adapted to be mounted so as to be engaged with a cover covering the front concave surface of a dish antenna. In this implementation, the vibratory system includes a vibrating arm that engages with the cover so as to induce vibrations on the cover to thereby reduce the accumulations of water, in either a frozen or liquid form, on the outer surface of the cover.

It will be appreciated that vibrating the cover induces vibratory waves on a flexible cover that can bounce water particles off of the outer surface of the cover. It will also be appreciated that inducing vibrations can, in some circumstances, reduce the accumulation of even frozen water on the outer surface of the cover at a lower cost than providing heat into the interior space between a cover and the inner concave surface of a dish antenna.

These and other objects and advantages of the present invention will become more apparent from the following description taken in conjunction with the accompanying drawings.

DETAILED DESCRIPTION OF THE PREFERRED EMBODIMENT

Figure 1:
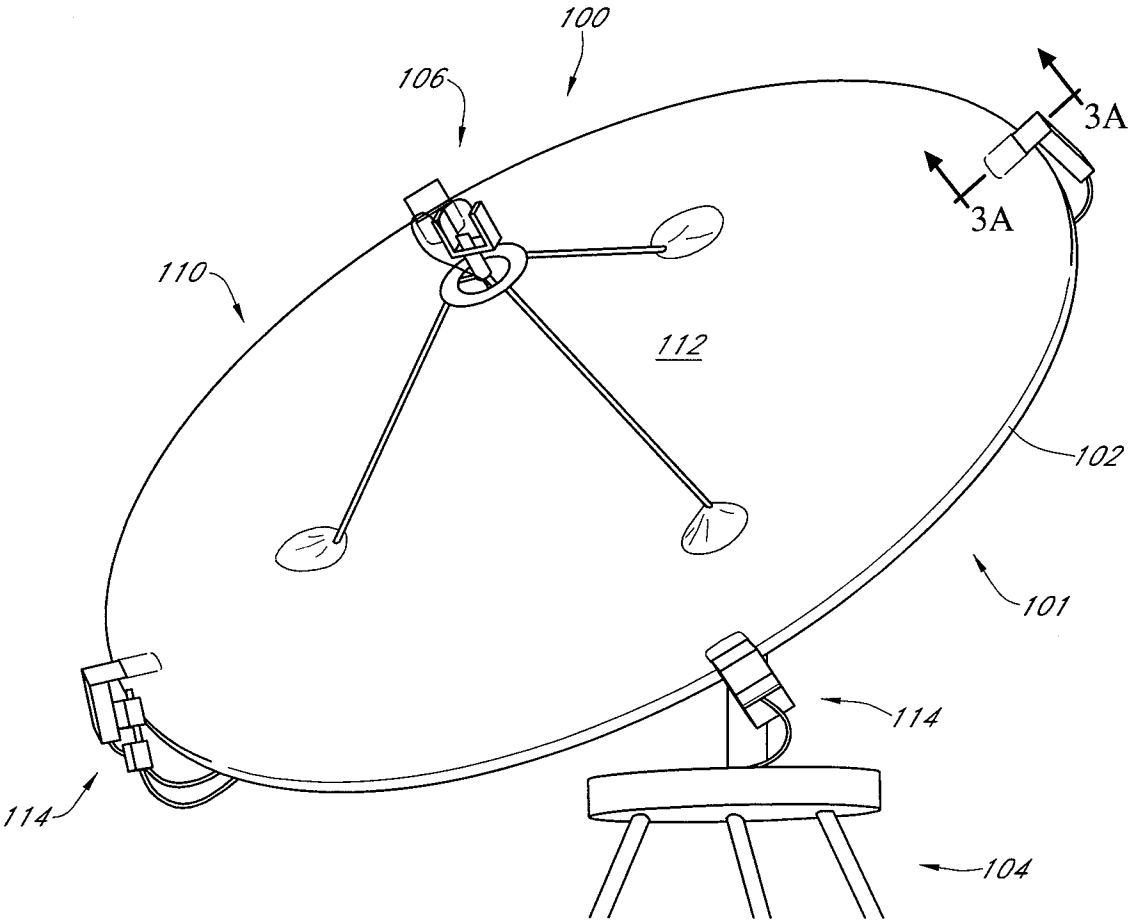
FIG. 1 is a perspective view of an exemplary dish antenna, such as a satellite antenna, having a cover to inhibit the accumulation of water on an inner surface of the antenna and a vibratory assembly engaged with the cover to inhibit the accumulation of water on the outer surface of the cover.

Reference will now be made to the drawings, wherein like numerals refer to like parts throughout. Referring now to FIG. 1, a dish antenna assembly 100 is shown. The dish antenna 100 has a concave shaped receiving dish 101 that has an outer lip 102. The receiving dish 101 can be mounted on a stand 104 or other mounting structure. The exact configuration of the mounting structure is dependant upon the size and application of the antenna.

Satellite antennas used with digital satellite television systems are often small antennas, less than one-half meter in diameter, that have a simplified mounting system allowing the antennas to be mounted to a person's home. Larger dish communications antennas may be 5 or 10 meters or more in diameter and have a much more elaborate mounting structure or stand 104.

As is also illustrated in FIG. 1, the dish antenna assembly also includes a collector assembly 106 that is adapted to receive signals that are reflected from the inner concave surface of the dish 101. The size and shape of the collector will also vary depending upon the size and the application of the dish antenna assembly 100.

As is also shown in FIG. 1, the assembly 100 includes a cover 110 that is mounted to the outer lip 102 of the dish antenna 100 so as to cover the interior concave space. The cover 110 is preferably formed of a material such as polytetrafluoroethylene (PTFE), commonly sold under the trademark Teflon, as this allows the transmission of many types of signals including digital satellite entertainment signals and also microwave-type communications signals. The cover 110 is desirably sized and spaced to inhibit the accumulation of water in either a frozen or liquid form on the inner concave surface of the dish antenna 101. The cover 110 may be very similar to those described in U.S. Pat. No. 5,798,735 or sold by W.B. Walton Enterprises of Riverside, Calif. under the trademark Snowshield.

As shown, the cover 110 defines an outer surface 112 where water can accumulate. The water that accumulates on the outer cover 112 may be in the form of snow, frost, sleet, rain, dew or condensation. If sufficient water accumulates on the outer surface 112 of the cover, the transmission of signals either to or from the dish antenna assembly 100 can be interrupted.

As is also shown in FIG. 1, one or more vibration mechanisms 114 can be mounted to the lip 102 of the antenna dish 101 so as to engage with the cover 110 to vibrate the cover 110. As discussed above, the cover 110 is preferably formed of a PTFE coated cloth material such that when a sudden mechanical force is exerted against the cover 110, the cover will vibrate thereby inducing vibratory waves to travel across the cover 110. These vibratory waves can thereby induce physical dislocations on the outer surface 112 of the cover 110 which can dislodge water that is accumulating on the outer surface 112 of the cover 110 thereby improving the transmission of communications signals to and from the antenna assembly 100.

It will be understood that the number of vibration mechanisms 114 can vary depending upon a number of different factors. One factor is, of course, the size of the antenna dish 101 and the cover 110. Smaller antenna dishes, such as those used in the satellite TV applications, may require only a single vibration mechanism 114 while larger antennas 100 may require multiple vibration mechanisms 114 to vibrate the outer surface 112 with sufficient force to dislodge water over substantially all of the outer surface 112.

Another factor that influences the number of vibration mechanisms 114 that are installed on a particular antenna is the force and frequency of the vibrations that are induced upon the cover 112 by the vibration mechanisms. In one implementation, the vibration mechanism 114 vibrates at a frequency of 3600 rpm.

Figure 2:
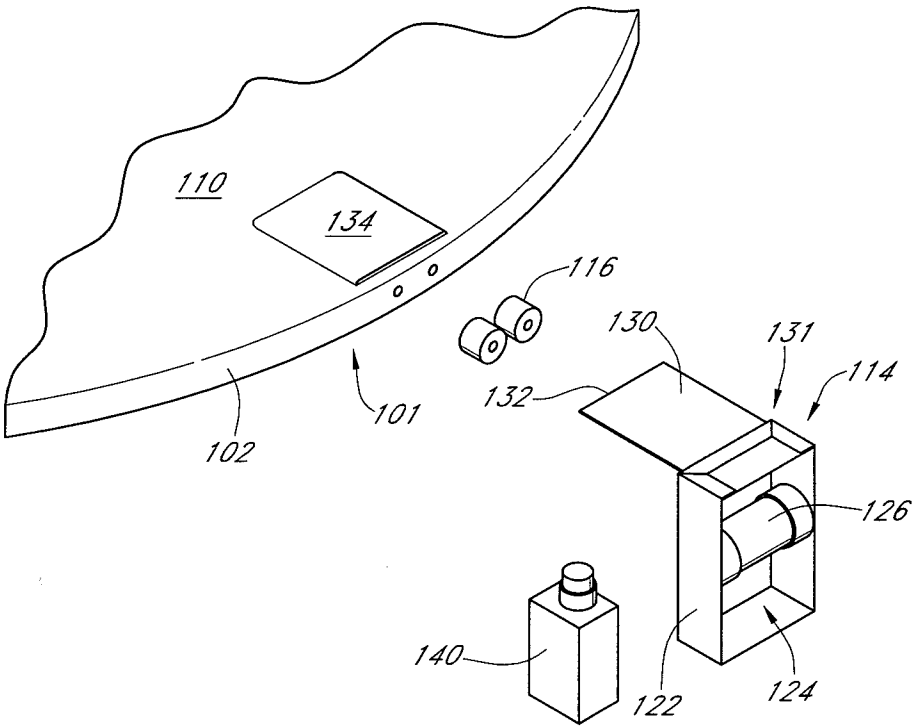
FIG. 2 is an exploded perspective view of the vibratory assembly of FIG. 1 as it is mounted to the satellite antenna of FIG. 1.

FIG. 2 is an exploded perspective view of a vibration mechanism 114. As shown, the vibration mechanism include a housing 122 that defines an interior space 124. An asynchronous electric motor 126, such as a Model M60 Electric Vibration Motor C.F. K 0.20/0.29 motor made by Italvibras of Modena, Italy, is positioned within the interior space 124 of the housing 122. In one implementation, the motor 126 is made asynchronous by positioning weights about the motor's shaft so that when the shaft is rotated, the motor 126 is induced into vibrating.

The vibrations are preferably transmitted to the housing 122. The housing 122 is, however, mounted to the rim 102 of the satellite dish 101 via isolation members 116 so that the vibrations induced by the motor 126 are preferably isolated from the dish antenna 101. It will be appreciated that if sufficient vibrations are transmitted to the antenna dish 101 that the vibrations may interfere with the ability of the antenna dish 101 to receive and transmit signals. The isolation members 116 and the housing are coupled to the lip 102 of the dish antenna 101 via bolts 118 shown in FIGS. 3A and 3B hereinbelow.

As is also illustrated in FIG. 2, the vibration mechanism 114 also includes a vibratory arm 130 that is attached to a first end 131 of the housing 122. The vibratory arm 130 is an elongate arm formed of a flexible material such as plastic such as PTFE having, in one specific implementation, a thickness of ¼", a width of 4¾" and a length of 8". In another implementation, the vibration unit for larger antennas is ½" thick, 6" wide and 12" long. As the housing 122 is induced to vibrate by the motor 126, the vibratory motion is transmitted to the arm 130. In fact, the moment length of the arm 130 results in a greater deflection of the outer end 132 of the arm thereby inducing the transmission of greater vibratory forces to the cover 110 in the manner that will be described in greater detail hereinbelow.

As is also shown in FIG. 2, the cover 110 defines an arm receptacle 134 that receives the outer end 132 of the arm 130. As will be described in greater detail below, the receptacle can have a variety of different configurations but preferably engages with at least one surface of the arm 130 so that vibratory movement of the arm 130 is physically transmitted to the cover 110.

It will also be appreciated that the above-described mechanism for inducing vibrations is but one example of a mechanism for inducing vibrations. Thus, persons of ordinary skill in the art will appreciate that any of a number of different mechanisms for inducing vibrations in the cover 110 can be implemented without departing from the spirit and scope of the present invention.

It will also be appreciated that the size and number of vibration units will depend upon the size of the antenna cover that is to be vibrated. By way of example, the Applicant recommends for antennas having a diameter of 0.6 to 1.8 meters to have a single vibration unit of the smaller dimensions listed above that uses a 35 watt vibration motor. For antennas having diameters of 1.9 to 3.8 meters, the Applicant recommends a larger 45 watt vibration motor with a vibration unit having the larger dimensions listed above. For antennas having dimensions of 3.9 to 4.5 meters, the Applicant recommends two of the larger 45 watt vibration motors/systems; for 4.6 to 6.3 meter diameters, the Applicant recommends four of the larger 45 watt vibration motors/systems; and for 6.4 to 7.3 meter antennas, the Applicant recommends six of the larger 45 watt vibration motors/systems. It will be appreciated that various changes in the structure of the vibration apparatus will result in the need for more or less vibration units depending upon the size of the antenna cover to be vibrated and that such changes are within the teachings of the present invention.

As is also shown in FIG. 2, the system 100 may also include one or more moisture sensors 140 that are adapted to sense the presence of moisture. As will be described in greater detail below, the system 100 includes a control system that incorporates the moisture sensor so as to selectively activate the vibration mechanism 114 when sensing atmospheric conditions or other conditions whereby water may be present on the outer surface 112 of the cover 110. In one embodiment, the moisture sensor 140 is a PS-2 type sensor available from ASE Company of Colorado Springs, Colo.

Figure 3A:
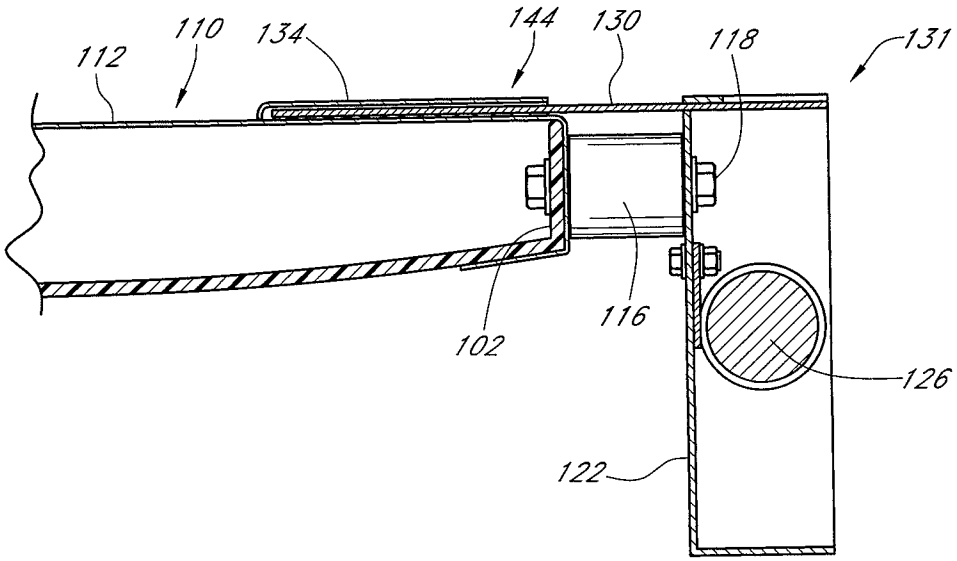
FIG. 3A is a cross-sectional view of the assembly of FIG. 2 as it is engaged with the satellite cover of FIG. 1 in a first embodiment.

Referring now to FIG. 3A, a first embodiment of an arm receptacle 134 formed in the cover 110 is shown. In this embodiment, a pocket 144 is formed adjacent the outer surface 112 of the cover 110 that is sized so as to receive the outer end 132 of the vibration arm 130. The pocket 144 may be sewn onto the outer surface 112 of the cover 110 by positioning an additional layer of material 146 proximate the outer surface 112 adjacent the rim 102 of the satellite dish 101 so as to be able to receive the arm 130. This will, however, require that the cover 110 be custom made with the pockets 144 to receive the arms 130 of the vibration mechanisms 114.

Figure 3B:
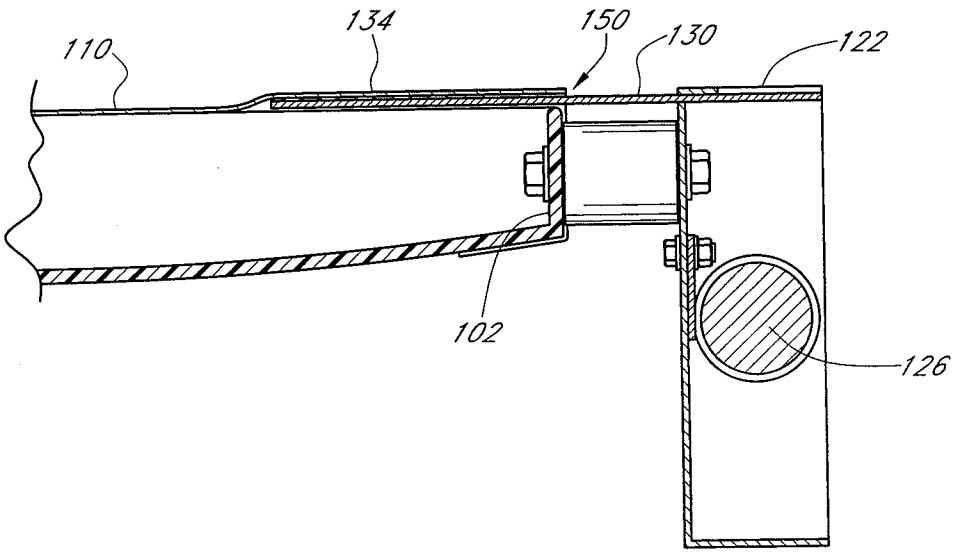
FIG. 3B is a cross-sectional view of the assembly of the assembly of FIG. 2 as it is engaged with the satellite cover of FIG. 2 in a second embodiment.

FIG. 3B illustrates an alternative embodiment whereby a slit 150 is cut into the cover 110 adjacent the outer rim 102 of the satellite dish 101 proximate the mounting location of the vibratory mechanisms 114. The slit 150 allows the arm 130 to protrude into the interior space 103 defined by an inner surface 113 of the cover 110 and the inner surface of the dish antenna 101. In this instance, only a single side of the arm 130 is engaged with the cover 110 as opposed to two sides in the embodiment shown in FIG. 3A.

Nonetheless, sufficient motion of the arm 130 can result in sufficient vibratory motion being imparted onto the cover 110 so as to remove accumulations of water on the outer surface of the cover. It will be further appreciated that the implementation of FIG. 3B allows for existing covers 110 to be readily retrofitted to receive the vibration mechanism 114 thereby allowing existing dish antenna assemblies 100 to be fitted with the vibration mechanism 114.

It will be further appreciated that the interconnection between the vibration mechanism 114 and the cover 110 can be accomplished in any of a number of different ways without departing from the spirit and scope of the present invention so long as vibrations or other types of dislocations are transmitted to the cover 110 with sufficient force or frequency to remove accumulations of liquid or frozen water from the front surface 112 of the cover 110.

Figure 4:
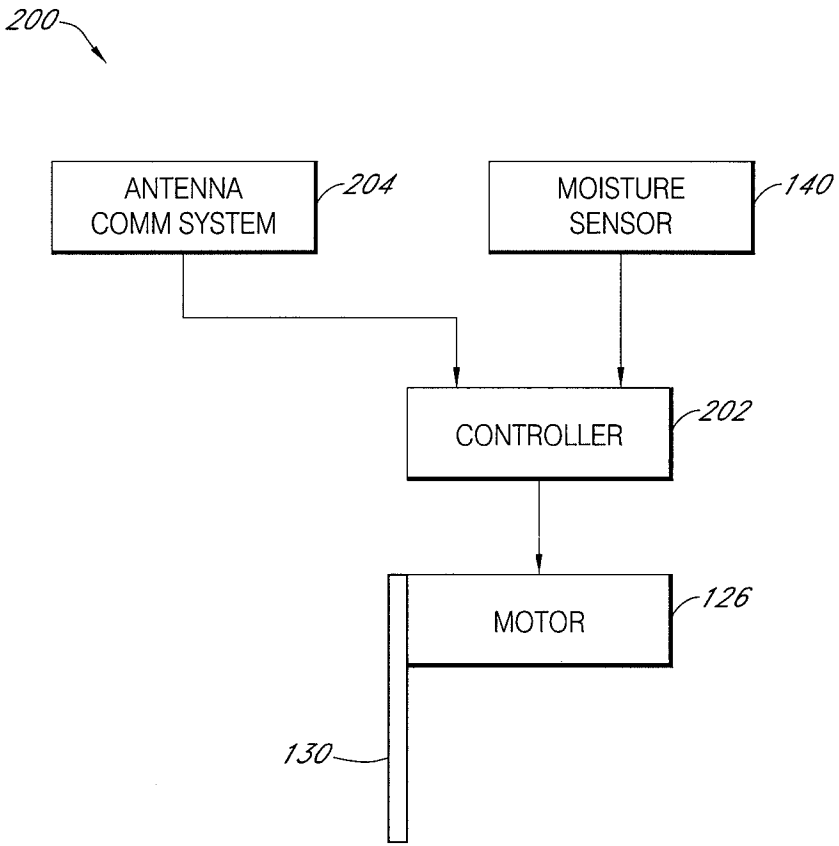
FIG. 4 is a block diagram of an exemplary control system of the system of FIG. 1 to inhibit accumulations of water from interrupting communications with the dish antenna of FIG. 1.

FIG. 4 is a simplified block diagram of an exemplary control system 200 that controls the operation of the vibratory mechanism 114. As shown, a controller 202 receives input signals from the moisture sensor 140 and induces the motor 126 to vibrate when moisture is detected in sufficient quantities to conclude that there are possible accumulations of water on the outer surface 112 of the cover 110.

In one implementation, the motor is induced to vibrate when the moisture sensor indicates the presence of moisture. In another implementation, the motor is induced to vibrate when moisture is detected and the temperature is lower than a pre-selected threshold, e.g., 39 degrees Fahrenheit. In this implementation, the motor will continue to vibrate so long as the temperature is below the pre-selected threshold or, if the temperature exceeds the pre-selected threshold, the motor will vibrate for a pre-selected time period, e.g., 30 minutes, and then cease vibration. In other implementations, such as with smaller antennas, the motor will vibrate so long as moisture is detected and, if moisture is no longer detected, it will vibrate for a pre-selected time period e.g., 15 minutes, and then shut down.

It will also be appreciated that other inputs can be provided to the controller 202 to control the operation of the vibration mechanisms 114. As shown in FIG. 4, a feedback loop 204 from a communications system attached to the antenna assembly 100 can also provide an indication of the need for the vibrations when the communications system is detecting a loss or degradation of signals to or from the dish antenna.

It will thus be appreciated that any of a number of different mechanisms and methods can be used to activate and control the vibration mechanisms without departing from the spirit and the scope of the present invention. This system is thus capable of reducing accumulations of water, in both liquid and frozen form, on the outer surface of the cover that is positioned over the satellite. This system, in some applications, uses less energy than previous systems that introduced air into the space between the cover and the antenna, particularly when the air being introduced was heated air.

It will be appreciated that various substitutions, modifications and changes to the form and the detail of the apparatus and methods of the invention may be made by those skilled in the art without departing from the spirit and scope of the present invention. Hence, the present invention should not be limited or defined by the aforementioned description, but should be defined by the appended claims.

What is claimed is:

1. A system for inhibiting moisture from interrupting communication to or from a dish antenna having a front surface and a rim, the system comprising:

a cover that is adapted to be positioned over the front surface of the dish antenna so as to inhibit the accumulation of moisture on an inner surface of the dish antenna, the cover adapted to be coupled to the rim of the dish antenna, the cover adapted to cover the front surface of the dish antenna; and at least one vibration device that provides vibratory signals to the cover so as to vibrate the cover to thereby inhibit the accumulation of water on the cover wherein the at least one vibration device includes a motor that is mounted to the rim of the dish antenna via vibration isolators so as to be positioned outside of the front surface of the dish antenna and so as to limit vibrations transferred from the at least one vibration device to the dish antenna and a signal receiving portion of the dish antenna.

2. The system of claim 1, wherein the cover comprises a cover formed of polytetrafluoroethylene.

3. The system of claim 1, wherein the vibration device comprises a flexible vibratory member having a first end and a second end, the first end attached to the vibration device and the second end attached to the cover, wherein vibration of the vibration device results in greater deflection of the second end of the vibratory member than the first end thereby increasing displacement of the cover, and wherein the displacement of the cover is substantially transverse to a plane defined by the rim of the antenna dish.

4. The system of claim 3, wherein the cover includes an opening adjacent the rim of the dish antenna that receives a portion of the vibration device whereby vibrations are physically transferred from the at least one vibration device.

5. The system of claim 4, wherein the opening in the cover comprises a pocket so that the portion of the at least one vibration device that is engaged with the cover is engaged on two separate sides.

6. The system of claim 1, wherein the at least one vibration device includes a housing that is mounted adjacent the antenna, a motor positioned within the housing and a vibration member that is coupled with the motor so as to vibrate in response to operation of the motor and wherein the vibration member physically contacts at least a portion of the cover so as to communicate the vibration to the cover.

7. The system of claim 6, wherein the at least one vibration device includes a moisture sensor that provides signals to activate the motor upon determining that moisture may be present on the cover.

8. The system of claim 6, wherein the housing is mounted on the rim of the antenna via isolation washers so as to inhibit the transmission of vibrations to the antenna.

9. The system of claim 8, wherein the vibration member comprises a member made of plastic material that is approximately 8" to 12" long and 4-¾" to 6" wide and ¼" to ½" thick.

10. The system of claim 1, wherein the dish antenna includes a collector assembly adapted to receive signals reflected from the dish antenna and wherein the cover is adapted to be positioned adjacent the dish antenna and includes at least one aperture formed therethrough to allow a portion of the collector assembly to pass therethrough.

11. A system for inhibiting the accumulation of moisture on a front surface of a cover of a dish antenna having a front surface and a rim wherein the cover is covering a concave opening of the antenna to inhibit accumulation of moisture on an inner surface of the antenna, the system comprising a vibration mechanism that is selectively engaged to apply vibrations to the cover of the antenna upon sensing a condition where water may have accumulated on the front surface of the cover that may result in the interruption of signals to or from the antenna wherein the vibration mechanism includes a motor that is mounted to the rim of the dish antenna via vibration isolation devices so as to be positioned outside of the front surface of the dish antenna and so as to limit vibrations transferred to the dish antenna and a signal receiving portion of the dish antenna, the vibration mechanism comprising a flexible vibratory member having a first end and a second end, the first end attached to the vibration mechanism and the second end attached to the cover, wherein vibration of the vibration mechanism results in greater deflection of the second end of the vibratory member than the first end thereby increasing the displacement of the cover.

12. The system of claim 11, wherein the cover includes an opening adjacent the rim of the dish antenna that receives a portion of the vibration mechanism whereby vibrations are physically transferred from the vibration mechanism.

13. The system of claim 12, wherein the opening in the cover comprises a pocket so that the portion of the vibration mechanism that is engaged with the cover is engaged on two separate sides.

14. The system of claim 11, wherein the vibration mechanism includes a housing that is mounted adjacent the antenna, a motor positioned within the housing and a vibration member that is coupled with the motor so as to vibrate in response to operation of the motor, wherein the vibration member physically contacts at least a portion of the cover so as to communicate the vibration to the cover, and wherein the vibration communicated to the cover comprises displacement substantially transverse to a plane defined by the rim of the antenna dish.

15. The system of claim 14, wherein the vibration mechanism includes a moisture sensor that provides signals to activate the motor upon determining that moisture may be present on the cover.

16. The system of claim 14, wherein the housing is mounted on the rim of the antenna via isolation washers so as to inhibit the transmission of vibrations to the antenna.

17. The system of claim 16, wherein the vibration member comprises a member made of plastic material that is approximately 8" to 12" long and 4-¾" to 6" wide and ¼" to ½" thick.

18. A method of inhibiting the interruption of communication signals to a concave dish antenna having a front surface and a rim via the accumulation of water, the method comprising:

positioning a cover on the opening of the antenna to inhibit the accumulation of moisture on the inner surface of the concave dish antenna;

sensing conditions that are indicative of the accumulation of moisture on an outer surface of the antenna that may interrupt communications signals to the antenna; and inducing vibrations to the cover so as to remove water from the outer surface of the cover by activating a motor that is mounted on the rim of the antenna so as to be positioned outside of the front surface of the antenna, wherein the vibrations are transmitted to the cover via a vibratory member and wherein the vibratory member amplifies the vibration of the motor resulting in greater deflection of the cover.

19. The method of claim 18, wherein inducing vibrations to the cover comprises physically vibrating the cover and displacing the cover substantially transverse to the cover.

20. The method of claim 19, wherein physically vibrating the cover comprises inducing vibrations by activating more than one motor mounted on the rim of the dish antenna.

* * * * *